US006867674B1

(12) United States Patent
Schutte et al.

(10) Patent No.: US 6,867,674 B1
(45) Date of Patent: Mar. 15, 2005

(54) TRANSFORMER

(75) Inventors: Thorsten Schutte, Vasteras (SE); Par Holmberg, Vasteras (SE); Jan Brangefalt, Vasteras (SE); Christian Sasse, Vasteras (SE); Peter Carstensen, Huddinge (SE)

(73) Assignee: Asea Brown Boveri AB, Vasteras (SE)

( * ) Notice: Subject to any disclaimer, the term of this patent is extended or adjusted under 35 U.S.C. 154(b) by 0 days.

(21) Appl. No.: 09/554,921

(22) PCT Filed: Nov. 30, 1998

(86) PCT No.: PCT/EP98/07729

§ 371 (c)(1),
(2), (4) Date: Aug. 28, 2000

(87) PCT Pub. No.: WO99/28923

PCT Pub. Date: Jun. 10, 1999

(30) Foreign Application Priority Data

Nov. 28, 1997 (GB) ..... 9725331

(51) Int. Cl.[7] ..... H01F 27/28
(52) U.S. Cl. ..... 336/180; 336/183
(58) Field of Search ..... 336/65, 83, 174, 336/175, 178, 210–217, 180–183

(56) References Cited

U.S. PATENT DOCUMENTS

| | | | |
|---|---|---|---|
| 681,800 | A | 9/1901 | Lasche |
| 1,304,451 | A | 5/1919 | Burnham |
| 1,418,856 | A | 6/1922 | Williamson |
| 1,481,585 | A | 1/1924 | Beard |
| 1,728,915 | A | 9/1929 | Blankenship et al. |
| 1,742,985 | A | 1/1930 | Burnham |
| 1,747,507 | A | 2/1930 | George |
| 1,756,672 | A | 4/1930 | Barr |
| 1,762,775 | A | 6/1930 | Ganz |
| 1,781,308 | A | 11/1930 | Mauritz Vos |
| 1,861,182 | A | 5/1932 | Hendey et al. |
| 1,974,406 | A | 9/1934 | Apple et al. |
| 2,006,170 | A | 6/1935 | Juhlin |
| 2,206,856 | A | 7/1940 | Shearer |
| 2,217,430 | A | 10/1940 | Baudry |

(List continued on next page.)

FOREIGN PATENT DOCUMENTS

| | | |
|---|---|---|
| AT | 399790 | 7/1995 |
| BE | 565063 | 2/1957 |
| CH | 391071 | 4/1965 |
| CH | 534448 | 2/1973 |
| CH | 539328 | 4/1973 |

(List continued on next page.)

OTHER PUBLICATIONS

Shipboard Electrical Insulation; G. L. Moses, 1951, pp2&3, no month.
ABB Elkrafthandbok; ABB AB; 1988 ; pp274–276, no month.
Elkraft teknisk Handbook, 2 Elmaskiner; A Alfredsson et al; 1988, pp 121–123, no month.

(List continued on next page.)

*Primary Examiner*—Tuyen T. Nguyen
(74) *Attorney, Agent, or Firm*—Oblon, Spivak, McClelland, Maier & Neustadt, P.C.

(57) ABSTRACT

A power transformer having at least one high voltage winding and one low voltage winding. Each of the windings includes at least one current-carrying conductor, a first layer having semiconducting properties provided around said conductor, a solid insulating layer provided around said first layer, and a second layer having semiconducting properties provided around said insulating layer. The windings are intermixed such that turns of the high voltage winding are mixed with turns of the low voltage winding.

20 Claims, 3 Drawing Sheets

U.S. PATENT DOCUMENTS

| | | | | |
|---|---|---|---|---|
| 2,241,832 | A | | 5/1941 | Wahlquist |
| 2,251,291 | A | | 8/1941 | Reichelt |
| 2,256,897 | A | | 9/1941 | Davidson et al. |
| 2,295,415 | A | | 9/1942 | Monroe |
| 2,415,652 | A | | 2/1947 | Norton |
| 2,424,443 | A | | 7/1947 | Evans |
| 2,436,306 | A | | 2/1948 | Johnson |
| 2,446,999 | A | | 8/1948 | Camilli |
| 2,459,322 | A | | 1/1949 | Johnston |
| 2,462,651 | A | | 2/1949 | Lord |
| 2,498,238 | A | | 2/1950 | Berberich et al. |
| 2,721,905 | A | | 10/1955 | Monroe |
| 2,780,771 | A | | 2/1957 | Lee |
| 2,846,599 | A | | 8/1958 | McAdam |
| 2,885,581 | A | | 5/1959 | Pileggi |
| 2,943,242 | A | | 6/1960 | Schaschl et al. |
| 2,947,957 | A | | 8/1960 | Spindler |
| 2,959,699 | A | | 11/1960 | Smith et al. |
| 2,962,679 | A | | 11/1960 | Stratton |
| 2,975,309 | A | | 3/1961 | Seidner |
| 3,098,893 | A | | 7/1963 | Pringle et al. |
| 3,130,335 | A | | 4/1964 | Rejda |
| 3,143,269 | A | | 8/1964 | Van Eldik |
| 3,157,806 | A | | 11/1964 | Wiedemann |
| 3,158,770 | A | | 11/1964 | Coggeshall et al. |
| 3,268,766 | A | | 8/1966 | Amos |
| 3,304,599 | A | | 2/1967 | Nordin |
| 3,354,331 | A | | 11/1967 | Broeker et al. |
| 3,365,657 | A | | 1/1968 | Webb |
| 3,372,283 | A | | 3/1968 | Jaecklin |
| 3,418,530 | A | | 12/1968 | Cheever |
| 3,435,262 | A | | 3/1969 | Bennett et al. |
| 3,437,858 | A | | 4/1969 | White |
| 3,444,407 | A | | 5/1969 | Yates |
| 3,447,002 | A | | 5/1969 | Ronnevig |
| 3,484,690 | A | | 12/1969 | Wald |
| 3,560,777 | A | | 2/1971 | Moeller |
| 3,593,123 | A | | 7/1971 | Williamson |
| 3,631,519 | A | | 12/1971 | Salahshourian |
| 3,644,662 | A | | 2/1972 | Salahshourian |
| 3,651,402 | A | | 3/1972 | Leffmann |
| 3,670,192 | A | | 6/1972 | Andersson et al. |
| 3,675,056 | A | | 7/1972 | Lenz |
| 3,684,821 | A | | 8/1972 | Miyauchi et al. |
| 3,716,652 | A | | 2/1973 | Lusk et al. |
| 3,716,719 | A | | 2/1973 | Angelery et al. |
| 3,727,085 | A | | 4/1973 | Goetz et al. |
| 3,740,600 | A | | 6/1973 | Turley |
| 3,746,954 | A | | 7/1973 | Myles et al. |
| 3,758,699 | A | | 9/1973 | Lusk et al. |
| 3,778,891 | A | | 12/1973 | Arnasino et al. |
| 3,781,739 | A | | 12/1973 | Meyer |
| 3,792,399 | A | | 2/1974 | McLyman |
| 3,801,843 | A | | 4/1974 | Corman et al. |
| 3,809,933 | A | | 5/1974 | Sugawara et al. |
| 3,820,048 | A | | 6/1974 | Ohta et al. |
| 3,881,647 | A | | 5/1975 | Wolfe |
| 3,884,154 | A | | 5/1975 | Marten |
| 3,891,880 | A | | 6/1975 | Britsch |
| 3,902,000 | A | | 8/1975 | Forsyth et al. |
| 3,932,779 | A | | 1/1976 | Madsen |
| 3,932,791 | A | | 1/1976 | Oswald |
| 3,943,392 | A | | 3/1976 | Keuper et al. |
| 3,947,278 | A | | 3/1976 | Youtsey |
| 3,965,408 | A | | 6/1976 | Higuchi et al. |
| 3,968,388 | A | | 7/1976 | Lambrecht et al. |
| 3,971,543 | A | | 7/1976 | Shanahan |
| 3,974,314 | A | | 8/1976 | Fuchs |
| 3,995,785 | A | | 12/1976 | Arick et al. |
| 4,001,616 | A | | 1/1977 | Lonseth et al. |
| 4,008,409 | A | | 2/1977 | Rhudy et al. |
| 4,031,310 | A | | 6/1977 | Jachimowicz |
| 4,039,740 | A | | 8/1977 | Iwata |
| 4,041,431 | A | | 8/1977 | Enoksen |
| 4,047,138 | A | | 9/1977 | Steigerwald |
| 4,064,419 | A | | 12/1977 | Peterson |
| 4,084,307 | A | | 4/1978 | Schultz et al. |
| 4,085,347 | A | | 4/1978 | Lichius |
| 4,088,953 | A | | 5/1978 | Sarian |
| 4,091,138 | A | | 5/1978 | Takagi et al. |
| 4,091,139 | A | | 5/1978 | Quirk |
| 4,099,227 | A | | 7/1978 | Liptak |
| 4,103,075 | A | | 7/1978 | Adam |
| 4,106,069 | A | | 8/1978 | Trautner et al. |
| 4,107,092 | A | | 8/1978 | Carnahan et al. |
| 4,109,098 | A | | 8/1978 | Olsson et al. |
| 4,121,148 | A | | 10/1978 | Platzer |
| 4,134,036 | A | | 1/1979 | Curtiss |
| 4,134,055 | A | | 1/1979 | Akamatsu |
| 4,134,146 | A | | 1/1979 | Stetson |
| 4,149,101 | A | | 4/1979 | Lesokhin et al. |
| 4,152,615 | A | | 5/1979 | Calfo et al. |
| 4,160,193 | A | | 7/1979 | Richmond |
| 4,164,672 | A | | 8/1979 | Flick |
| 4,164,772 | A | | 8/1979 | Hingorani |
| 4,177,397 | A | | 12/1979 | Lill |
| 4,177,418 | A | | 12/1979 | Brueckner et al. |
| 4,184,186 | A | | 1/1980 | Barkan |
| 4,200,817 | A | | 4/1980 | Bratoljic |
| 4,200,818 | A | | 4/1980 | Ruffing et al. |
| 4,206,434 | A | | 6/1980 | Hase |
| 4,207,427 | A | | 6/1980 | Beretta et al. |
| 4,207,482 | A | | 6/1980 | Neumeyer et al. |
| 4,208,597 | A | | 6/1980 | Mulach et al. |
| 4,229,721 | A | | 10/1980 | Koloczek et al. |
| 4,238,339 | A | | 12/1980 | Khutoretsky et al. |
| 4,239,999 | A | | 12/1980 | Vinokurov et al. |
| 4,245,182 | A | | 1/1981 | Aotsu et al. |
| 4,246,694 | A | | 1/1981 | Raschbichler et al. |
| 4,255,684 | A | | 3/1981 | Mischler et al. |
| 4,258,280 | A | | 3/1981 | Starcevic |
| 4,262,209 | A | | 4/1981 | Berner |
| 4,274,027 | A | | 6/1981 | Higuchi et al. |
| 4,281,264 | A | | 7/1981 | Keim et al. |
| 4,292,558 | A | | 9/1981 | Flick et al. |
| 4,307,311 | A | | 12/1981 | Grozinger |
| 4,308,476 | A | | 12/1981 | Schuler |
| 4,308,575 | A | | 12/1981 | Mase |
| 4,310,966 | A | | 1/1982 | Breitenbach |
| 4,317,001 | A | | 2/1982 | Silver et al. |
| 4,320,645 | A | | 3/1982 | Stanley |
| 4,321,518 | A | | 3/1982 | Akamatsu |
| 4,326,181 | A | | 4/1982 | Allen |
| 4,330,726 | A | | 5/1982 | Albright et al. |
| 4,337,922 | A | | 7/1982 | Streiff et al. |
| 4,341,989 | A | | 7/1982 | Sandberg et al. |
| 4,347,449 | A | | 8/1982 | Beau |
| 4,347,454 | A | | 8/1982 | Gellert et al. |
| 4,353,612 | A | | 10/1982 | Meyers |
| 4,357,542 | A | | 11/1982 | Kirschbaum |
| 4,360,748 | A | | 11/1982 | Raschbichler et al. |
| 4,367,425 | A | | 1/1983 | Mendelsohn et al. |
| 4,368,418 | A | | 1/1983 | Demello et al. |
| 4,369,389 | A | | 1/1983 | Lambrecht |
| 4,371,745 | A | | 2/1983 | Sakashita |
| 4,387,316 | A | | 6/1983 | Katsekas |
| 4,400,675 | A | * | 8/1983 | Thomas ..... 336/160 |
| 4,403,163 | A | | 9/1983 | Rarmerding et al. |
| 4,403,205 | A | * | 9/1983 | Leibinger et al. ..... 336/180 |
| 4,404,486 | A | | 9/1983 | Keim et al. |
| 4,411,710 | A | | 10/1983 | Mochizuki et al. |

4,421,284 A 12/1983 Pan
4,425,521 A 1/1984 Rosenberry, Jr. et al.
4,426,771 A 1/1984 Wang et al.
4,429,244 A 1/1984 Nikitin et al.
4,431,960 A 2/1984 Zucker
4,443,725 A 4/1984 Derderian et al.
4,470,884 A 9/1984 Carr
4,473,765 A 9/1984 Butman, Jr. et al.
4,475,075 A 10/1984 Munn
4,477,690 A 10/1984 Nikitin et al.
4,481,438 A 11/1984 Keim
4,488,079 A 12/1984 Dailey et al.
4,503,284 A 3/1985 Minnick et al.
4,510,077 A 4/1985 Elton
4,517,471 A 5/1985 Sachs
4,523,249 A 6/1985 Arimoto
4,538,131 A 8/1985 Baier et al.
4,546,210 A 10/1985 Akiba et al.
4,551,780 A 11/1985 Canay
4,552,990 A 11/1985 Persson et al.
4,557,038 A 12/1985 Wcislo et al.
4,560,896 A 12/1985 Vogt et al.
4,565,929 A 1/1986 Baskin et al.
4,588,916 A 5/1986 Lis
4,590,416 A 5/1986 Porche et al.
4,594,630 A 6/1986 Rabinowitz et al.
4,607,183 A 8/1986 Rieber et al.
4,615,109 A 10/1986 Wcislo et al.
4,618,795 A 10/1986 Cooper et al.
4,619,040 A 10/1986 Wang et al.
4,633,109 A 12/1986 Feigel
4,650,924 A 3/1987 Kauffman et al.
4,656,316 A 4/1987 Meltsch
4,656,379 A 4/1987 McCarty
4,663,603 A 5/1987 van Riemsdijk et al.
4,677,328 A 6/1987 Kumakura
4,687,882 A 8/1987 Stone et al.
4,692,731 A 9/1987 Osinga
4,723,104 A 2/1988 Rohatyn
4,737,704 A 4/1988 Kalinnikov et al.
4,745,314 A 5/1988 Nakano
4,766,365 A 8/1988 Bolduc et al.
4,785,138 A 11/1988 Breitenbach et al.
4,795,933 A 1/1989 Sakai
4,827,172 A 5/1989 Kobayashi
4,845,308 A 7/1989 Womack, Jr. et al.
4,847,747 A 7/1989 Abbondanti
4,853,565 A * 8/1989 Elton et al. ..... 310/45
4,859,810 A 8/1989 Cloetens et al.
4,860,430 A 8/1989 Raschbichler et al.
4,864,266 A 9/1989 Feather et al.
4,883,230 A 11/1989 Lindstrom
4,894,284 A 1/1990 Yamanouchi et al.
4,914,386 A 4/1990 Zocholl
4,918,347 A 4/1990 Takaba
4,918,835 A 4/1990 Wcislo et al.
4,924,342 A 5/1990 Lee
4,926,079 A 5/1990 Niemela et al.
4,942,326 A 7/1990 Butler, III et al.
4,949,001 A 8/1990 Campbell
4,994,952 A 2/1991 Silva et al.
4,997,995 A 3/1991 Simmons et al.
5,012,125 A 4/1991 Conway
5,036,165 A 7/1991 Elton et al.
5,036,238 A 7/1991 Tajima
5,066,881 A 11/1991 Elton et al.
5,067,046 A 11/1991 Elton et al.
5,083,360 A 1/1992 Valencic et al.
5,086,246 A 2/1992 Dymond et al.
5,094,703 A 3/1992 Takaoka et al.
5,097,241 A 3/1992 Smith et al.
5,097,591 A 3/1992 Wcislo et al.
5,111,095 A 5/1992 Hendershot
5,124,607 A 6/1992 Rieber et al.
5,136,459 A 8/1992 Fararooy
5,140,290 A 8/1992 Dersch
5,153,460 A 10/1992 Bovino et al.
5,168,662 A 12/1992 Nakamura et al.
5,175,396 A 12/1992 Emery et al.
5,187,428 A 2/1993 Hutchison et al.
5,235,488 A 8/1993 Koch
5,246,783 A 9/1993 Spenadel et al.
5,264,778 A 11/1993 Kimmel et al.
5,293,146 A 3/1994 Aosaki et al.
5,304,883 A 4/1994 Denk
5,305,961 A 4/1994 Errard et al.
5,321,308 A 6/1994 Johncock
5,323,330 A 6/1994 Asplund et al.
5,325,008 A 6/1994 Grant
5,327,637 A 7/1994 Britenbach et al.
5,341,281 A 8/1994 Skibinski
5,343,139 A 8/1994 Gyugyi et al.
5,355,046 A 10/1994 Weigelt
5,365,132 A 11/1994 Hann et al.
5,387,890 A 2/1995 Estop et al.
5,397,513 A 3/1995 Steketee, Jr.
5,400,005 A 3/1995 Bobry
5,452,170 A 9/1995 Ohde et al.
5,468,916 A 11/1995 Litenas et al.
5,500,632 A 3/1996 Halser, III
5,510,942 A 4/1996 Bock et al.
5,530,307 A 6/1996 Horst
5,545,853 A 8/1996 Hildreth
5,550,410 A 8/1996 Titus
5,583,387 A 12/1996 Takeuchi et al.
5,587,126 A 12/1996 Steketee, Jr.
5,598,137 A 1/1997 Alber et al.
5,607,320 A 3/1997 Wright
5,612,510 A 3/1997 Hildreth
5,663,605 A 9/1997 Evans et al.
5,672,926 A 9/1997 Brandes et al.
5,689,223 A 11/1997 Demarmels et al.
5,807,447 A 9/1998 Forrest

FOREIGN PATENT DOCUMENTS

CH 657482 8/1986
DE 40414 8/1887
DE 277012 7/1914
DE 336418 6/1920
DE 372390 3/1923
DE 387973 1/1924
DE 425551 2/1926
DE 426793 3/1926
DE 432169 7/1926
DE 433749 9/1926
DE 435608 10/1926
DE 435609 10/1926
DE 441717 3/1927
DE 443011 4/1927
DE 460124 5/1928
DE 482506 9/1929
DE 501181 7/1930
DE 523047 4/1931
DE 568508 1/1933
DE 572030 3/1933
DE 584639 9/1933
DE 586121 10/1933
DE 604972 11/1934
DE 629301 4/1936
DE 673545 3/1939
DE 719009 3/1942
DE 846583 8/1952

| | | | |
|---|---|---|---|
| DE | 875227 | | 4/1953 |
| DE | 1807391 | | 5/1970 |
| DE | 2050674 | | 5/1971 |
| DE | 1638176 | | 6/1971 |
| DE | 2155371 | | 5/1973 |
| DE | 2400698 | | 7/1975 |
| DE | 2520511 | | 11/1976 |
| DE | 2656389 | | 6/1978 |
| DE | 2721905 | | 11/1978 |
| DE | 137164 | | 8/1979 |
| DE | 138840 | | 11/1979 |
| DE | 2824951 | | 12/1979 |
| DE | 2835386 | | 2/1980 |
| DE | 2839517 | | 3/1980 |
| DE | 2854520 | | 6/1980 |
| DE | 3009102 | | 9/1980 |
| DE | 2913697 | | 10/1980 |
| DE | 2920478 | | 12/1980 |
| DE | 3028777 | | 3/1981 |
| DE | 2939004 | | 4/1981 |
| DE | 3006382 | | 8/1981 |
| DE | 3008818 | | 9/1981 |
| DE | 3305225 | | 8/1984 |
| DE | 3309051 | | 9/1984 |
| DE | 3441311 | | 5/1986 |
| DE | 3543106 | | 6/1987 |
| DE | 2917717 | | 8/1987 |
| DE | 3612112 | | 10/1987 |
| DE | 3726346 | | 2/1989 |
| DE | 4023903 | | 11/1991 |
| DE | 4022476 | | 1/1992 |
| DE | 4233558 | | 3/1994 |
| DE | 4409794 | | 8/1995 |
| DE | 4412761 | | 10/1995 |
| DE | 4420322 | | 12/1995 |
| DE | 19547229 | | 6/1997 |
| EP | 049104 | | 4/1982 |
| EP | 0493704 | | 4/1982 |
| EP | 0056580 | A1 | 7/1982 |
| EP | 078908 | | 5/1983 |
| EP | 0120154 | | 10/1984 |
| EP | 0130124 | | 1/1985 |
| EP | 0142813 | | 5/1985 |
| EP | 0155405 | | 9/1985 |
| EP | 0174783 | | 3/1986 |
| EP | 0234521 | | 9/1987 |
| EP | 0244069 | | 11/1987 |
| EP | 0246377 | | 11/1987 |
| EP | 0265868 | | 5/1988 |
| EP | 0274691 | | 7/1988 |
| EP | 0280759 | | 9/1988 |
| EP | 0282876 | | 9/1988 |
| EP | 0309096 | | 3/1989 |
| EP | 0314860 | | 5/1989 |
| EP | 0316911 | | 5/1989 |
| EP | 0317248 | | 5/1989 |
| EP | 0335430 | | 10/1989 |
| EP | 0342554 | | 11/1989 |
| EP | 0406437 | | 1/1991 |
| EP | 0439410 | | 7/1991 |
| EP | 0440865 | | 8/1991 |
| EP | 0490705 | | 6/1992 |
| EP | 0571155 | | 11/1993 |
| EP | 0620570 | | 10/1994 |
| EP | 0642027 | | 3/1995 |
| EP | 0671632 | | 9/1995 |
| EP | 0676777 | | 10/1995 |
| EP | 0677915 | | 10/1995 |
| EP | 0684679 | | 11/1995 |
| EP | 0684682 | | 11/1995 |
| EP | 0695019 | | 1/1996 |
| EP | 0732787 | | 9/1996 |
| EP | 0738034 | | 10/1996 |
| EP | 0740315 | | 10/1996 |
| EP | 0751605 | | 1/1997 |
| EP | 0780926 | | 6/1997 |
| EP | 0802542 | | 10/1997 |
| EP | 0375101 | | 6/1999 |
| FR | 805544 | | 4/1936 |
| FR | 841351 | | 1/1938 |
| FR | 847899 | | 12/1938 |
| FR | 1011924 | | 4/1949 |
| FR | 1126975 | | 3/1955 |
| FR | 1238795 | | 7/1959 |
| FR | 2108171 | | 5/1972 |
| FR | 2251938 | | 6/1975 |
| FR | 2305879 | | 10/1976 |
| FR | 2376542 | | 7/1978 |
| FR | 2467502 | | 4/1981 |
| FR | 2556146 | | 6/1985 |
| FR | 2594271 | | 8/1987 |
| FR | 2708157 | | 1/1995 |
| GB | 123906 | | 3/1919 |
| GB | 268271 | | 3/1927 |
| GB | 293861 | | 11/1928 |
| GB | 292999 | | 4/1929 |
| GB | 319313 | | 7/1929 |
| GB | 518993 | | 3/1940 |
| GB | 537609 | | 6/1941 |
| GB | 540456 | | 10/1941 |
| GB | 589071 | | 6/1947 |
| GB | 685416 | | 1/1953 |
| GB | 702892 | | 1/1954 |
| GB | 715226 | | 9/1954 |
| GB | 723457 | | 2/1955 |
| GB | 763761 | | 12/1956 |
| GB | 805721 | | 12/1958 |
| GB | 827600 | | 2/1960 |
| GB | 854728 | | 11/1960 |
| GB | 870583 | | 6/1961 |
| GB | 913386 | | 12/1962 |
| GB | 965741 | | 8/1964 |
| GB | 992249 | | 5/1965 |
| GB | 1024583 | | 3/1966 |
| GB | 1053337 | | 12/1966 |
| GB | 1059123 | | 2/1967 |
| GB | 1103098 | | 2/1968 |
| GB | 1103099 | | 2/1968 |
| GB | 1117401 | | 6/1968 |
| GB | 1135242 | | 12/1968 |
| GB | 1147049 | | 4/1969 |
| GB | 1157885 | | 7/1969 |
| GB | 1174659 | | 12/1969 |
| GB | 1236082 | | 6/1971 |
| GB | 1268770 | | 3/1972 |
| GB | 1319257 | | 6/1973 |
| GB | 1322433 | | 7/1973 |
| GB | 1340983 | | 12/1973 |
| GB | 1341050 | | 12/1973 |
| GB | 1365191 | | 8/1974 |
| GB | 1395152 | | 5/1975 |
| GB | 1424982 | | 2/1976 |
| GB | 1426594 | | 3/1976 |
| GB | 1438610 | | 6/1976 |
| GB | 1445284 | | 8/1976 |
| GB | 1479904 | | 7/1977 |
| GB | 1493163 | | 11/1977 |
| GB | 1502938 | | 3/1978 |
| GB | 1525745 | | 9/1978 |
| GB | 2000625 | | 1/1979 |
| GB | 1548633 | | 7/1979 |
| GB | 2046142 | | 11/1979 |

| | | |
|---|---|---|
| GB | 2022327 | 12/1979 |
| GB | 2025150 | 1/1980 |
| GB | 2034101 | 5/1980 |
| GB | 1574796 | 9/1980 |
| GB | 2070341 | 9/1981 |
| GB | 2070470 | 9/1981 |
| GB | 2071433 | 9/1981 |
| GB | 2081523 | 2/1982 |
| GB | 2099635 | 12/1982 |
| GB | 2105925 | 3/1983 |
| GB | 2106306 | 4/1983 |
| GB | 2106721 | 4/1983 |
| GB | 2136214 | 9/1984 |
| GB | 2140195 | 11/1984 |
| GB | 2268337 | 1/1994 |
| GB | 2273819 | 6/1994 |
| GB | 2283133 | 4/1995 |
| GB | 2289992 | 12/1995 |
| GB | 2308490 | 6/1997 |
| JP | 60206121 | 3/1959 |
| JP | 57043529 | 8/1980 |
| JP | 59076156 | 10/1982 |
| JP | 59159642 | 2/1983 |
| JP | 6264964 | 9/1985 |
| JP | 1129737 | 5/1989 |
| JP | 3245748 | 2/1990 |
| JP | 4179107 | 11/1990 |
| JP | 318253 | 1/1991 |
| JP | 424909 | 1/1992 |
| JP | 5290947 | 4/1992 |
| JP | 6196343 | 12/1992 |
| JP | 6233442 | 2/1993 |
| JP | 6325629 | 5/1993 |
| JP | 7057951 | 8/1993 |
| JP | 7264789 | 3/1994 |
| JP | 8167332 | 12/1994 |
| JP | 8264039 | 11/1995 |
| JP | 9200989 | 1/1996 |
| LU | 67199 | 3/1972 |
| RU | SU1019553 | 1/1980 |
| RU | SU1511810 | 5/1987 |
| SE | 90308 | 9/1937 |
| SE | 305899 | 11/1968 |
| SE | 255156 | 2/1969 |
| SE | 341428 | 12/1971 |
| SE | 453236 | 1/1982 |
| SE | 457792 | 6/1987 |
| SE | 502417 | 12/1993 |
| SU | 792302 | 1/1971 |
| SU | 425268 | 9/1974 |
| SU | 694939 | 1/1982 |
| SU | 955369 | 8/1983 |
| WO | WO8202617 | 8/1982 |
| WO | WO8502302 | 5/1985 |
| WO | WO9011389 | 10/1990 |
| WO | WO9012409 | 10/1990 |
| WO | WO9101059 | 1/1991 |
| WO | WO9101585 | 2/1991 |
| WO | WO9107807 | 3/1991 |
| WO | WO9109442 | 6/1991 |
| WO | WO8115862 | 10/1991 |
| WO | WO9201328 | 1/1992 |
| WO | WO9203870 | 3/1992 |
| WO | WO9321681 | 10/1993 |
| WO | WO9406194 | 3/1994 |
| WO | WO9518058 | 7/1995 |
| WO | WO9522153 | 8/1995 |
| WO | WO9524049 | 9/1995 |
| WO | WO9622606 | 7/1996 |
| WO | WO9622607 | 7/1996 |
| WO | WO9630144 | 10/1996 |
| WO | WO9710640 | 3/1997 |
| WO | WO9711831 | 4/1997 |
| WO | WO9716881 | 5/1997 |
| WO | WO9745288 | 12/1997 |
| WO | WO9745847 | 12/1997 |
| WO | WO9745848 | 12/1997 |
| WO | WO9745906 | 12/1997 |
| WO | WO9745907 | 12/1997 |
| WO | WO 97/45908 | 12/1997 |
| WO | WO9745912 | 12/1997 |
| WO | WO9745914 | 12/1997 |
| WO | WO9745915 | 12/1997 |
| WO | WO9745916 | 12/1997 |
| WO | WO9745918 | 12/1997 |
| WO | WO9745919 | 12/1997 |
| WO | WO9745920 | 12/1997 |
| WO | WO9745921 | 12/1997 |
| WO | WO9745922 | 12/1997 |
| WO | WO9745923 | 12/1997 |
| WO | WO9745924 | 12/1997 |
| WO | WO9745925 | 12/1997 |
| WO | WO9745926 | 12/1997 |
| WO | WO9745927 | 12/1997 |
| WO | WO9745928 | 12/1997 |
| WO | WO9745929 | 12/1997 |
| WO | WO9745930 | 12/1997 |
| WO | WO9745931 | 12/1997 |
| WO | WO9745932 | 12/1997 |
| WO | WO9745933 | 12/1997 |
| WO | WO9745934 | 12/1997 |
| WO | WO9745935 | 12/1997 |
| WO | WO9745936 | 12/1997 |
| WO | WO9745937 | 12/1997 |
| WO | WO9745938 | 12/1997 |
| WO | WO9745939 | 12/1997 |
| WO | WO9747067 | 12/1997 |
| WO | WO9820595 | 5/1998 |
| WO | WO9820596 | 5/1998 |
| WO | WO9820597 | 5/1998 |
| WO | WO 98/20598 | 5/1998 |
| WO | WO9820600 | 5/1998 |
| WO | WO 98/20602 | 5/1998 |
| WO | WO9821385 | 5/1998 |
| WO | WO9827634 | 6/1998 |
| WO | WO9827635 | 6/1998 |
| WO | WO9827636 | 6/1998 |
| WO | WO9829927 | 7/1998 |
| WO | WO9829928 | 7/1998 |
| WO | WO9829929 | 7/1998 |
| WO | WO9829930 | 7/1998 |
| WO | WO9829931 | 7/1998 |
| WO | WO9829932 | 7/1998 |
| WO | WO9824240 | 8/1998 |
| WO | WO9833731 | 8/1998 |
| WO | WO9833736 | 8/1998 |
| WO | WO9833737 | 8/1998 |
| WO | WO9834238 | 8/1998 |
| WO | WO 98/34239 | 8/1998 |
| WO | WO9834241 | 8/1998 |
| WO | WO9834242 | 8/1998 |
| WO | WO9834243 | 8/1998 |
| WO | WO9834244 | 8/1998 |
| WO | WO9834245 | 8/1998 |
| WO | WO9834246 | 8/1998 |
| WO | WO9834247 | 8/1998 |
| WO | WO9834248 | 8/1998 |
| WO | WO9834249 | 8/1998 |
| WO | WO9834250 | 8/1998 |
| WO | WO9834309 | 8/1998 |
| WO | WO9834312 | 8/1998 |
| WO | WO9834315 | 8/1998 |

| | | |
|---|---|---|
| WO | WO9834321 | 8/1998 |
| WO | WO9834322 | 8/1998 |
| WO | WO9834323 | 8/1998 |
| WO | WO9834325 | 8/1998 |
| WO | WO9834326 | 8/1998 |
| WO | WO9834327 | 8/1998 |
| WO | WO9834328 | 8/1998 |
| WO | WO9834329 | 8/1998 |
| WO | WO9834330 | 8/1998 |
| WO | WO9834331 | 8/1998 |
| WO | WO9917309 | 4/1999 |
| WO | WO9917311 | 4/1999 |
| WO | WO9917312 | 4/1999 |
| WO | WO9917313 | 4/1999 |
| WO | WO9917314 | 4/1999 |
| WO | WO9917315 | 4/1999 |
| WO | WO9917316 | 4/1999 |
| WO | WO9917422 | 4/1999 |
| WO | WO9917424 | 4/1999 |
| WO | WO9917425 | 4/1999 |
| WO | WO9917426 | 4/1999 |
| WO | WO9917427 | 4/1999 |
| WO | WO9917428 | 4/1999 |
| WO | WO9917429 | 4/1999 |
| WO | WO9917432 | 4/1999 |
| WO | WO9917433 | 4/1999 |
| WO | WO9919963 | 4/1999 |
| WO | WO9919969 | 4/1999 |
| WO | WO9919970 | 4/1999 |
| WO | WO9927546 | 6/1999 |
| WO | WO9928919 | 6/1999 |
| WO | WO9928921 | 6/1999 |
| WO | WO 99/28922 | 6/1999 |
| WO | WO9928923 | 6/1999 |
| WO | WO9928924 | 6/1999 |
| WO | WO9928925 | 6/1999 |
| WO | WO9928926 | 6/1999 |
| WO | WO9928927 | 6/1999 |
| WO | WO9928928 | 6/1999 |
| WO | WO9928929 | 6/1999 |
| WO | WO9928930 | 6/1999 |
| WO | WO9928931 | 6/1999 |
| WO | WO9928934 | 6/1999 |
| WO | WO9928994 | 6/1999 |
| WO | WO9929005 | 6/1999 |
| WO | WO 99/29005 | 6/1999 |
| WO | WO9929008 | 6/1999 |
| WO | WO9929011 | 6/1999 |
| WO | WO9929012 | 6/1999 |
| WO | WO9929013 | 6/1999 |
| WO | WO9929014 | 6/1999 |
| WO | WO9929015 | 6/1999 |
| WO | WO9929016 | 6/1999 |
| WO | WO9929017 | 6/1999 |
| WO | WO9929018 | 6/1999 |
| WO | WO9929019 | 6/1999 |
| WO | WO9929020 | 6/1999 |
| WO | WO9929021 | 6/1999 |
| WO | WO9929022 | 6/1999 |
| WO | WO 99/29023 | 6/1999 |
| WO | WO9929024 | 6/1999 |
| WO | WO 99/29025 | 6/1999 |
| WO | WO9929026 | 6/1999 |
| WO | WO9929029 | 6/1999 |
| WO | WO9929034 | 6/1999 |

OTHER PUBLICATIONS

High Voltage Cables in a New Class of Generators Powerformer; M. Leijon et al; Jun. 14, 1999; pp1–8.

Ohne Tranformator direkt ins Netz, Owman et al, ABB, AB; Feb. 8, 1999; pp48–51.

Submersible Motors and Wet–Rotor Motors for Centrifugal Pumps Submerged in the Fluid Handled; K.. Bienick, KSB; Feb. 25, 1988; pp9–17.

High Voltage Generators; G. Beschastnov et al; 1977; vol. 48. No. 6 pp1–7, no month.

Eine neue Type von Unterwassermotoren; Electrotechnik und Maschinenbam, 49; Aug. 1931; pp2–3, no date.

Problems in design of the 110–5OokV high–voltage generators; Nikiti et al; World Electrotechnical Congress; Jun. 21–27, 1977; Section 1. Paper #18, no date.

Manufacture and Testing of Roebel bars; P. Martl et al; 1960, Pub 86, vol. 8, pp 25–31, no month.

Hydroalternators of 110 to 220 kV Elektrotechn. Obz., vol. 64, No. 3, pp132–136 Mar. 1975; A. Abramov, no month.

Design Concepts for an Amorphous Metal Distribution Transformer; E. Boyd et al; IEEE 11/84, no date.

Neue Wege zum Bau zweipoliger Turbogeneratoren bis 2 GVA, 6OkV Elecktrotechnik und Maschinenbau Wien Janner 1972, Heft 1, Seite 1–11; G. Aichholzer, no month.

Optimizing designs of water–resistant magnet wire; V. Kuzenev et al; Elektrotekhnika, vol. 59, No. 12, pp35–40, 1988, no month.

Direct Generation of Alternating current at high voltages; R. Parsons; IEEE Journal, vol.67 #393, Jan. 15, 1929; pp1065–1080.

Stopfbachslose Umwalzpumpen– ein wichtiges Element im modemen Kraftwerkbau; H. Holz, KSB 1, pp13–19, 1960, no month.

Zur Geschichte der Brown Boveri–Synchron–Maschinen; Vierzig Jahre Generatorbau; Jan.–Feb. 1931 pp15–39, no date.

Technik und Anwendung moderner Tauchpumpen; A. Haumann; 1987.

High capacity synchronous generator having no tooth stator; V.S. Kildishev et al; No. 1, 1977 pp11–16, no month.

Der Asynchronmotor ais Antrieb stopfbcichsloser Pumpen; E. Picmaus; Eletrotechnik und Maschinenbay No. 78, pp153–155, 1961, no month.

Low core loss rotating flux transformer; R. F. Krause, et al; American Institute Physics J.Appl.Phys vol. 64 #10 Nov. 1988, pp5376–5378, no date.

An EHV bulk Power transmission line Made with Low Loss XLPE Cable;Ichihara et al; 8/92; pp3–6, no date.

Underground Transmission Systems Refernece Book; 1992;pp16–19; pp36–45; pp67–81, no month.

Power System Stability and Control; P. Kundur, 1994; pp23–25;p. 767, no month.

Six phase Synchronous Machine with AC and DC Stator Connections, Part II: Harmonic Studies and a proposed Uninterruptnuble Power Supply Scheme; R. Schiferl et al.; Aug. 1983 pp 2694–2701, no date.

Six phase Synchronous Machine with AC and DC Stator Connections, Part 1: Equivalent circuit representation and Steady–State Analysis; R. Schiferl et al;Aug. 1983; pp2685–2693, no date.

Reactive Power Compensation; T. Petersson; 1993; pp 1–23, no month.

Permanent Magnet Machines; K. Binns; 1987: pp 9–1 through 9–26, no month.

Hochspannungsaniagen for Wechselstrom; 97. Hochspannungsaufgaben an Generatoren und Motoren; Roth et al; 1938; pp452–455, no month.

Hochspannungsanlagen for Wechselstrom; 97. Hochspannungsaufgaben an Generatoren und Motoren; Roth et al; Spring 1959, pp30–33, no month.

Neue Lbsungsweege zum Entwurf grosser Turbogeneratoren bis 2GVA, 6OkV; G. Alcholzer, Sep. 1974, pp249–255, no date.

Advanced Turbine–generators– an assessment; A. Appleton, et al; International Conf. Proceedings, Lg HV Elec. Sys. Paris, FR, Aug.–Sep. 1976, vol. I, Section 11–02, p. 1–9, no date.

Fully slotless turbogenerators; E. Spooner; Proc., IEEE vol. 120 #12, Dec. 1973, no date.

Toroidal winding geometry for high voltagee superconducting alternators; J. Kirtley et al; MIT—Elec. Power Sys. Engrg. Lab for IEEE PES; Feb. 1974, no date.

High–Voltage Stator Winding Development; D Albright et al; Proj. Report EL339, Project 1716, Apr. 1984, no date.

POWERFORMER ™:A giant step in power plant engineering; Owman et al; CIGRE 1998, Paper 11:1.1, no month.

Thin Type DC/DC Converter using a coreless wire transformer; K. Onda et al; Proc. IEEE Power Electronics Spec. Conf.; Jun. 1994, pp330–334, no date.

Development of extruded polymer insulated superconducting cable; Jan. 1992, no date.

Transformer core losses; B. Richardson; Proc. IEEE May 1986, pp365–368, no date.

Cloth–transformer with divided windings and tension annealed amorphous wire; T. Yammamoto et al; IEEE Translation Journal on Magnetics in Japan vol. 4, No. 9 Sep. 1989.

A study of equipment sizes and constraints for a unified power flow controller; J Bian et al; IEEE 1996, no mth.

* cited by examiner

FIG. 3.
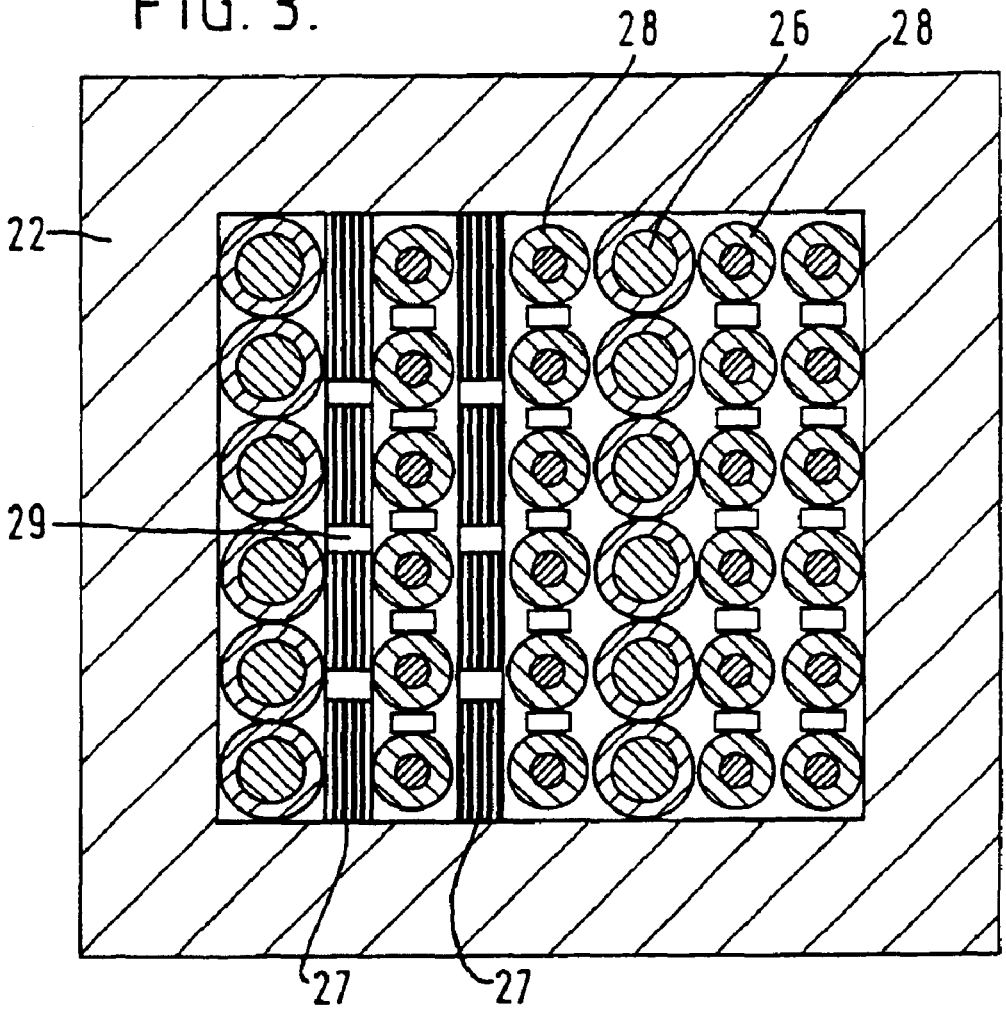
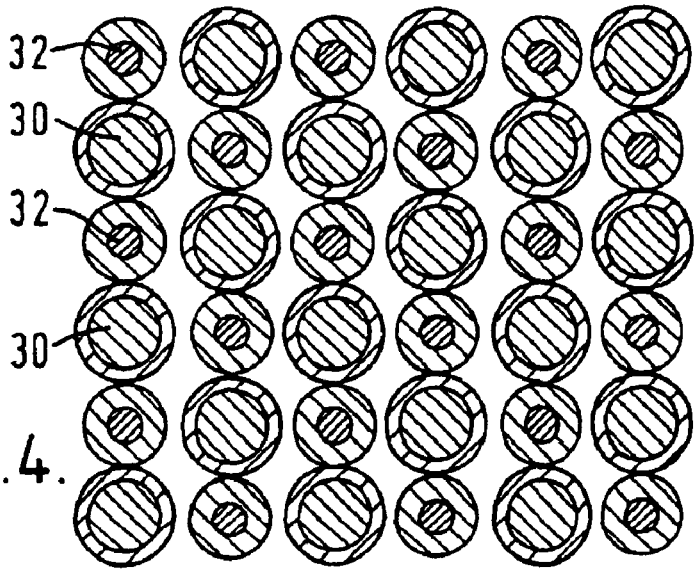
FIG.4.

TRANSFORMER

CROSS REFERENCE TO RELATED PATENT DOCUMENTS

The present document is based on published international patent application No. WO 99/28923, the entire contents of which being incorporated herein by reference.

BACKGROUND OF THE INVENTION

1. Field of the Invention

The present invention relates to a transformer having at least one high voltage winding and one low voltage winding. The invention is applicable to power transformers having rated outputs from a few hundred kVA to more than 1000 MVA and rated voltages from 3–4 kV to very high transmission voltages, e.g. from 400–800 kV or higher.

2. Discussion of the Background

Conventional power transformers are described in, e.g., A. C. Franklin and D. P. Franklin, "The & Transformer Book, A Practical Technology of the Power Transformer", published by Butterworths, 11th edition, 1990. Problems related to internal electric insulation and related topics are discussed in, e.g., H. P. Moser, "Transformerboard, Die Verwendung von Transformerboard in Grossleistungstransformatoren", published by H. Weidman AG, Rapperswil mit Gesamtherstellung: Birkhäuser AG, Basle, Switzerland.

In transmission and distribution of electric energy transformers are exclusively used for enabling exchange of electric energy between two or more electric systems. Transformers are available for powers from the 1 VA region to the 1000 MVA region and for voltages up to the highest transmission voltages used today.

Conventional power transformers include a transformer core, often formed of laminated commonly oriented sheet, normally of silicon iron. The core is formed of a number of legs connected by yokes which together form one or more core windows. Transformers having such a core are usually called core transformers. A number of windings are provided around the core legs. In power transformers, these windings are almost always arranged in a concentric configuration and distributed along the length of the core leg.

Other types of core structures are, however, known, e.g. so-called shell transformer structures, which normally have rectangular windings and rectangular leg sections disposed outside the windings.

Air-cooled conventional power transformers for lower power ranges are known. To render these transformers screen-protected an outer casing is often provided, which also reduces the external magnetic fields from the transformers.

Most power transformers are, however, oil-cooled the oil also serving as an insulating medium. An oil-cooled and oil-insulated conventional transformer is enclosed in an outer case which has to fulfil heavy demands. The construction of such a transformer with its associated circuit couplers, breaker elements and bushings is therefore complicated. The use of oil for cooling and insulation also complicates service of the transformer and constitutes an environmental hazard.

A so called "dry" transformer without oil insulation and oil cooling and adapted for rated powers up to 1000 MVA with rated voltages from 3–4 kV and up to very high transmission voltages has windings formed from conductors such as shown in FIG. 1. The conductor has a central conductor composed of a number of non-insulated (and optionally some insulated) wire strands 5 and 6000 respectively. Around the conductor there is an inner semiconducting casing 6 which is in contact with at least some of the non-insulated strands 5. This semiconducting casing 6 is in turn surrounded by the main insulation of the cable in the form of an extruded solid insulating layer 7. This insulating layer 7 is surrounded by an external semiconducting casing 8. The conductor area of the cable can vary between 80 and 3000 $mm^2$ and the external diameter of the cable between 20 and 250 mm. A metal shield 500 and sheath 5000 surround the external semiconducting casing 8, as shown.

Whilst the casings 6 and 8 are described as "semiconducting" they are in practice formed from a base polymer mixed with carbon black or metallic particles and have a resistivity of between 1 and $10^5$ Ωcm, preferably between 10 and 500 Ωcm. Suitable base polymers for the casings 6 and 8 (and for the insulating layer 7) include ethylene vinyl acetate copolymer/nitrile rubber, butyl grafted polythene, ethylene butyl acrylate copolymer, ethylene ethyl acrylate copolymer, ethylene propene rubber, polyethylenes of low density, poly butylene, poly methyl pentene, and ethylene acrylate copolymer.

The inner semiconducting casing 6 is rigidly connected to the insulating layer 7 over the entire interface therebetween. Similarly, the outer semiconducting casing 8 is rigidly connected to the insulating layer 7 over the entire interface therebetween. The casings 6 and 8 and the layer 7 form a solid insulation system and are conveniently extruded together around the wire strands 5.

Whilst the conductivity of the inner semiconducting casing 6 is lower than that of the electrically conductive wire strands 5, it is still sufficient to equalise the potential over its surface. Accordingly, the electric field is distributed uniformly around the circumference of the insulating layer 7 and the risk of localised field enhancement and partial discharge is minimised.

The potential at the outer semiconducting casing 8, which is conveniently at zero or ground or some other controlled potential, is equalised at this value by the conductivity of the casing. At the same time, the semiconducting casing 8 has sufficient resistivity to enclose the electric field. In view of this resistivity, it is desirable to connect the conductive polymeric casing to ground, or some other controlled potential, at intervals therealong.

The transformer according to the invention can be a one-, three- or multi-phase transformer and the core can be of any design. FIG. 2 shows a three-phase laminated core transformer. The core is of conventional design and includes three core legs 9, 10, 11 and joining yokes 12, 13.

The windings are concentrically wound around the core legs. In the transformer of FIG. 2 there are three concentric winding turns 14, 15, 16. The innermost winding turn 14 can represent the primary winding and the two other winding turns 15,16 the secondary winding. To make the Figure more clear such details as connections for the windings are left out. Spacing bars 17,18 are provided at certain locations around the windings. These bars 17,18 can be made of insulating material to define a certain space between the winding turns 14, 15, 16 for cooling, retention etc. or be made of an electrically conducting material to form a part of a grounding system of the windings 14, 15, 16.

The mechanical design of the individual coils of a transformer must be such that they can withstand forces resulting from short circuit currents. As these forces can be very high in a power transformer, the coils must be distributed and proportioned to give a generous margin of error and for that reason the coils cannot be designed so as to optimize performance in normal operation.

SUMMARY OF THE INVENTION

The main aim of the present invention is to alleviate the above mentioned problems relating to short circuit forces in a dry transformer.

This aim is achieved by a transformer having at least one high voltage winding and one low voltage winding. Each of the windings has a flexible conductor and is capable of containing an electric field. Each winding is magnetically permeable and the windings are intermixed such that turns of the high voltage winding are mixed with turns of the low voltage winding.

By manufacturing the transformer windings from a conductor having practically no electric fields outside an outer semiconducting casing thereof, the high and low voltage windings can be easily mixed in an arbitrary way for minimizing the short circuit forces. Such mixing would be unfeasible in the absence of the semiconductor casing or other mechanism for containing the electric field, and therefore would be considered impossible in a conventional oil-filled power transformer, because the insulation of the windings would not withstand the electrioc field existing between the high and low voltage windings.

It is also possible to reduce the distributed inductance and design the transformer core for the optimum match between window size and core.

According to an embodiment of the invention at least some of the turns of the low voltage winding are each split into a number of subturns connected in parallel for reducing the difference between the number of high voltage winding turns and the total number of low voltage winding turns to make the mixing of high voltage winding turns and low voltage winding turns as uniform as possible. Preferably, each turn of the low voltage winding is split into such a number of subturns, connected in parallel, such that the total number of low voltage winding turns is equal to the number of high voltage winding turns. High voltage and low voltage winding turns can then be mixed in a uniform manner such that the magnetic field generated by the low voltage winding turns substantially cancels the magnetic field from high voltage winding turns.

According to another advantageous embodiment, the turns of the high voltage winding and the turns of the low voltage winding are arranged symmetrically in a chessboard pattern, as seen in cross-section through the windings. This is an optimum arrangement for obtaining an efficient mutual cancellation of magnetic fields from the low and high voltage windings and thus an optimum arrangement for reducing the short circuit forces of the coils.

According to still another advantageous embodiment, at least two adjacent layers have substantially equal thermal expansion coefficients. In this way thermal damages to the winding is avoided.

Another aspect of the invention provides a method of winding a transformer that includes simultaneously winding high voltage and low voltage flexible conductors capable of containing an electric field but which are magnetically permeable, such that turns of the high voltage winding are intermixed with turns of the low voltage winding.

BRIEF DESCRIPTION OF THE DRAWINGS

To explain the invention in more detail, embodiments of the transformer according to the invention will now be described by way of example only with reference to the drawings in which:

FIGS. 3 and 4 show in cross-section different examples of the arrangement of the low and high voltage windings of the transformer of the invention.

DETAILED DESCRIPTION OF THE PREFERRED EMBODIMENTS

Figure 1:
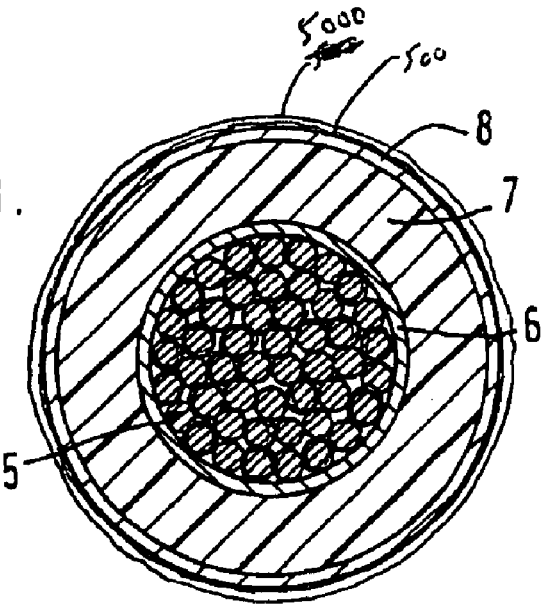
FIG. 1 shows an example of the cable used in the windings of the transformer according to the invention.

FIG. 3 is a cross-section through the portion of the windings of a power transformer according to the invention within the transformer core 22. A layer of a low voltage winding 26 is located between two layers of a high voltage winding 28. In this embodiment the transformation ratio is 1:2.

The direction of the current in the low voltage winding 26 is opposite to the direction of the current in the high voltage winding 28 and the resulting forces from the currents in the low and high voltage winding consequently partially cancel each other. This possibility of reducing the effect of current induced forces is of great importance, especially in case of a short circuit.

Struts 27 of laminated magnetic material, including spacers 29 providing air gaps, are located between the windings 26, 28 for improving transformer efficiency.

Cancellation of short circuit forces can be improved even further by splitting the turns of the low voltage winding into a number of subturns connected in parallel, preferably such that the total number of low voltage turns becomes equal to the number of high voltage winding turns. Thus, if the transformation ratio amounts to e.g. 1:3 each turn of the low voltage winding is split into three subturns. It is then possible to mix the low and high voltage windings in a more uniform pattern. An optimum arrangement of the windings is shown in FIG. 4, where low and high voltage winding turns 30 and 32 respectively are arranged symmetrically in a chessboard pattern. In this embodiment the magnetic fields from each turn of the low and high voltage windings 30, 32 substantially cancel each other and short circuit forces are almost completely cancelled.

When splitting a winding turn into a number of subturns the conducting area of each subturn can be reduced correspondingly since the sum of the current intensities in the subturns remains equal to the current intensity in the original winding turn. Thus, no more conducting material (normally copper) is needed when splitting the winding turns, provided that other conditions are unchanged.

Figure 5:
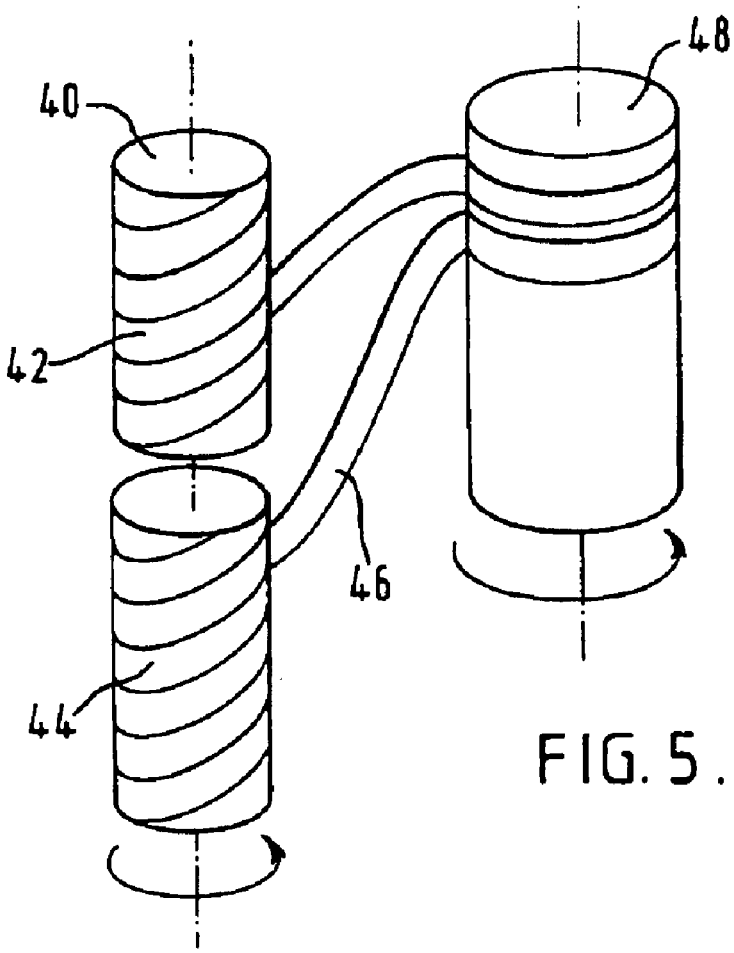
FIG. 5 shows a method of winding the transformer.
Figure 2:
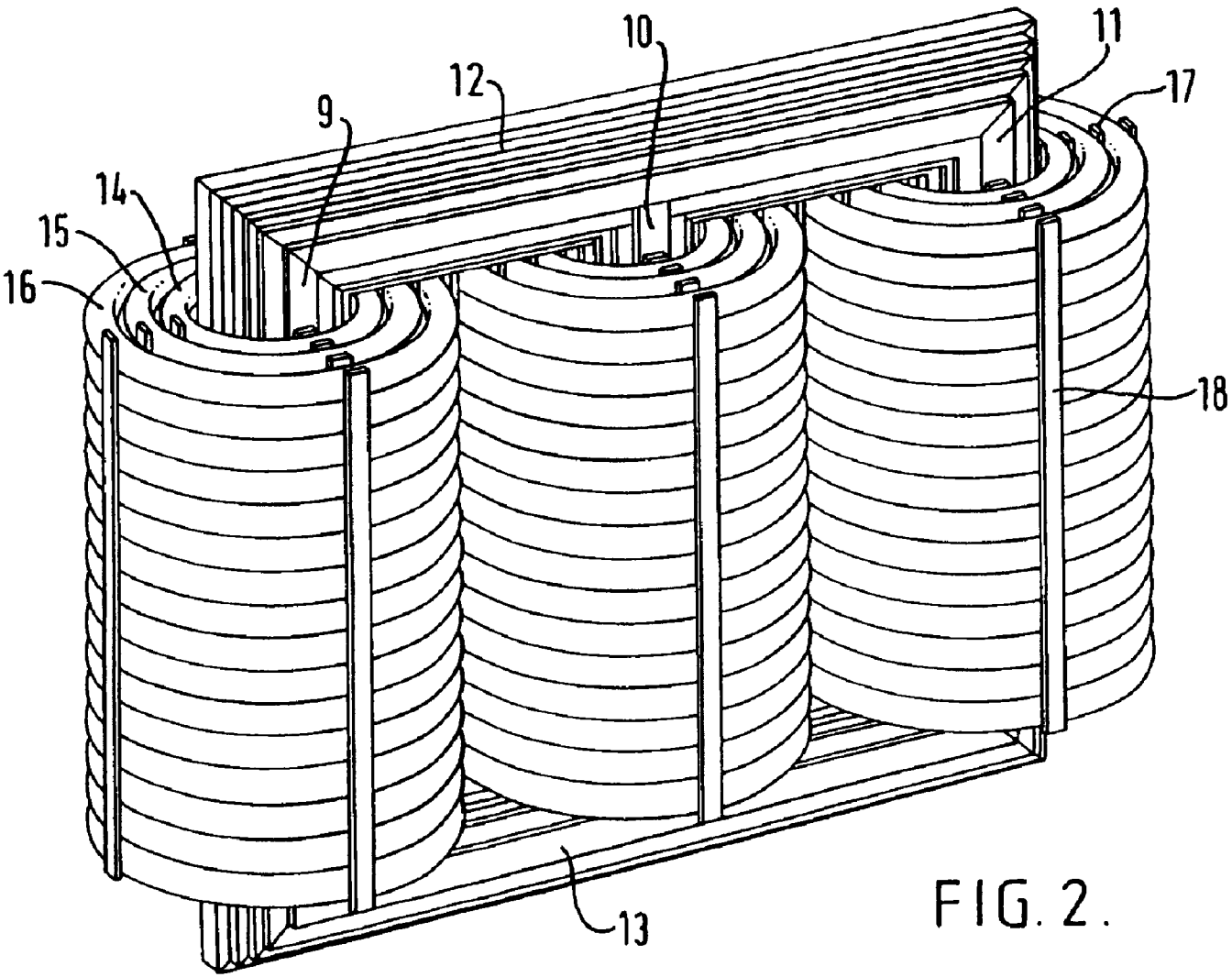
FIG. 2 shows a conventional three-phase transformer.

FIG. 5 schematically shows how the transformer of the invention can be wound. A first drum 40 carries a high voltage conductor 42 and a second drum 44 carries a low voltage conductor 46. The conductors 42, 46 are unwound from the drums 46, 44 and wound onto a transformer drum 48, all three drums 40, 44, 48 rotating simultaneously. Thus the high and low voltage conductors can easily be intermixed. Joints can be provided between different winding layers.

In the transformer of the invention the magnetic energy and hence the stray magnetic field in the windings is reduced. A wide range of impedances can be chosen.

The electrical insulation systems of the windings of a transformer according to the invention are intended to be able to handle very high voltages and the consequent electric and thermal loads which may arise at these voltages. By way of example, power transformers according to the invention may have rated powers from a few hundred kVA up to more than 1000 MVA and have rated voltages from 3–4 kV up to very high transmission voltages of from 400–800 kV or more. At high operating voltages, partial discharges, or PD, constitute a serious problem for known insulation systems. If cavities or pores are present in the insulation, internal corona discharge may arise whereby the insulating material is gradually degraded eventually leading to breakdown of the insulation. The electric load on the electrical insulation in use of a transformer according to the present invention is reduced by ensuring that the inner first layer of the insulation system which has semiconducting properties is at substantially the same electric potential as conductors of the central electrically conductor which it surrounds and the outer second layer of the insulation system which has semiconducting properties is at a controlled, e.g. earth, potential. Thus the electric field in the solid electrically insulating layer between these inner and outer layers is distributed substantially uniformly over the thickness of the intermediate layer. By having materials with similar thermal properties and with few defects in these layers of the insulation system, the possibility of PD is reduced at given operating voltages. The windings of the transformer can thus be designed to withstand very high operating voltages, typically up to 800 kV or higher.

Although it is preferred that the electrical insulation should be extruded in position, it is possible to build up an electrical insulation system from tightly wound, overlapping layers of film or sheet-like material. Both the semiconducting layers and the electrically insulating layer can be formed in this manner. An insulation system can be made of an all-synthetic film with inner and outer semiconducting layers or portions made of polymeric thin film of, for example, PP, PET, LDPE, or HDPE with embedded conducting particles, such as carbon black or metallic particles and with an insulating layer or portion between the semiconducting layers or portions.

For the lapped concept a sufficiently thin film will have butt gaps smaller than the so-called Paschen minima, thus rendering liquid impregnation unnecessary. A dry, wound multilayer thin film insulation has also good thermal properties.

Another example of an electrical insulation system is similar to a conventional cellulose based cable, where a thin cellulose based or synthetic paper or non-woven material is lap wound around a conductor. In this case the semiconducting layers, on either side of an insulating layer, can be made of cellulose paper or non-woven material made from fibers of insulating material and with conducting particles embedded. The insulating layer can be made from the same base material or another material can be used.

Another example of an insulation system is obtained by combining film and fibrous insulating material, either as a laminate or as co-lapped. An example of this insulation system is the commercially available so-called paper polypropylene laminate, PPLP, but several other combinations of film and fibrous parts are possible. In these systems various impregnations such as mineral oil can be used.

What is claimed is:

1. A transformer comprising:

a high voltage winding having turns, and a low voltage winding having turns, wherein, each of said high voltage winding and said low voltage winding being magnetically permeable and having a flexible conductor that is configured to contain an electric field, and the turns of the high voltage winding being intermixed with turns of the low voltage winding, said flexible conductor includes, a central electrical conductor, a first layer having semi-conducting properties provided around said electrical conductor, a solid insulating layer provided around said first layer, and a second layer having semi-conducting properties provided around said solid insulating layer and configured to contain an electric field in the flexible conductor, wherein said central conductor includes a plurality of strands of wire, a portion of said strands being insulated strands such that at most only a minority of said plurality of strands being in electrical contact with other strands that are not insulated.

2. A transformer according to claim 1, wherein:

said low voltage winding being wound as a low voltage winding layer positioned between two corresponding adjacent high voltage winding layers.

3. A transformer according to claim 1, wherein:

respective layers of said high voltage winding and said low voltage winding being arranged in a repeated periodic pattern comprising one high voltage winding layer, followed by a low voltage winding layer, followed by two high voltage winding layers, and followed by repetitions of a low voltage winding layer, followed by another two high voltage winding layers.

4. A transformer according to claim 1, wherein:

at least one of the turns of the low voltage winding being split into subturns, each of said subturns being connected in parallel so as to reduce a difference between a number of high voltage winding turns and a number of low voltage winding turns.

5. A transformer according to claim 4, wherein:

each turn of the low voltage winding being split into parallel-connected subturns equal in number to a corresponding number of high voltage winding turns.

6. A transformer according to claim 5, wherein:

the turns of the high voltage winding and the turns in the low voltage winding being arranged symmetrically in a chessboard pattern, when viewed in a cross-section through said high voltage winding and said low voltage winding.

7. A transformer according to claim 1, wherein:

a potential on said first layer being substantially equal to a potential on the conductor.

8. A transformer according to claim 1, wherein:

said second layer being arranged to constitute substantially an equipotential surface surrounding said conductor.

9. A transformer according to claim 8, wherein:

said second layer being connected to a node at a predetermined potential.

10. A transformer according to claim 9, wherein:

said predetermined potential being ground potential.

11. A transformer according to claim 1, wherein:

at least one pair of said first layer and said solid insulating layer, and said solid insulating layer and said second layer having substantially equal thermal expansion coefficients.

12. A transformer according to claim 1, wherein:

each of said first layer, said solid insulating layer and said second layer being fixedly connected to a respective adjacent layer along substantially a whole connecting surface.

13. A transformer according to claim 1, wherein:

a cross-section area of said central electrical conductor being in an inclusive range of 80 through 3000 mm.

14. A transformer according to claim 1, wherein:

an external diameter of the flexible conductor being in an inclusive range of 20 though 250 mm.

15. A transformer according to claim 1, further comprising:

struts of laminated magnetic material located between said high voltage winding and said low voltage winding.

16. A transformer according to claim 1, wherein:

the electric field contained in the flexible conductor being from a high voltage in said conductor in excess of 36 kV.

17. A transformer according to claim 1, wherein:

the flexible conductor being configured to handle a power in excess of 0.5 MVA.

18. A method of winding a transformer, comprising steps of:

simultaneously winding a high voltage flexible conductor and a low voltage flexible conductor configured to contain an electric field and being magnetically permeable to form a high voltage winding and a low voltage winding, and intermixing turns of the high voltage winding with turns of the low voltage winding, wherein said flexible conductor includes, a central electrical conductor, a first layer having semi-conducting properties provided around said electrical conductor, a solid insulating layer provided around said first layer, and a second layer having semi-conducting properties provided around said solid insulating layer and configured to contain an electric field in the flexible conductor, and said central conductor includes a plurality of strands of wire, a portion of said strands being insulated strands such that at most only a minority of said plurality of strands being in electrical contact with other strands that are not insulated.

19. A method according to claim 18 wherein:

said simultaneously winding step comprises simultaneously unwinding the high voltage winding and the low voltage winding from respective drums and winding the high voltage flexible conductor and the low voltage flexible conductor on to a transformer drum.

20. A transformer comprising:

a high voltage winding having turns, and a low voltage winding having turns, wherein, each of said high voltage winding and said low voltage winding comprising means for handling a high voltage and containing an electric field associated with said high voltage, and the turns of the high voltage winding being intermixed with turns of the low voltage winding, said means for handling a high voltage includes means for setting an electric potential of an outer surface of at least one of said high voltage winding and said low voltage winding to ground potential, wherein said means for handling a high voltage includes a flexible conductor, said flexible conductor includes, a central electrical conductor, a first layer having a semi-conducting properties provided around said electrical conductor, a solid insulating layer provided around said first layer, and a second layer having semi-conducting properties provided around said solid insulating layer an configured to contain an electric field in the flexible conductor, and said central conductor includes a plurality of strands of wire, a portion of said strands being insulated strands such that at most only a minority of said plurality of strands being in electrical contact with other strands that are not insulated.

* * * * *